US011771146B2

(12) United States Patent
O'Neill

(10) Patent No.: US 11,771,146 B2
(45) Date of Patent: Oct. 3, 2023

(54) BRASSIERE ADAPTED TO PREVENT UNDESIRED MOVEMENT WHEN WORN

(71) Applicant: Helena Gallegos O'Neill, Burke, VA (US)

(72) Inventor: Helena Gallegos O'Neill, Burke, VA (US)

(73) Assignee: Helena Gallegos O'Neill, Burke, VA (US)

( * ) Notice: Subject to any disclaimer, the term of this patent is extended or adjusted under 35 U.S.C. 154(b) by 352 days.

(21) Appl. No.: 16/948,045

(22) Filed: Aug. 28, 2020

(65) Prior Publication Data

US 2022/0061408 A1 Mar. 3, 2022

(51) Int. Cl.
*A41C 3/02* (2006.01)
*A41C 3/00* (2006.01)

(52) U.S. Cl.
CPC ..... *A41C 3/02* (2013.01); *A41C 3/0007* (2013.01); *A41C 3/0035* (2013.01)

(58) Field of Classification Search
None
See application file for complete search history.

(56) References Cited

U.S. PATENT DOCUMENTS 1,510,428 A * 9/1924 Voliva ..... A41C 3/00 450/3
1,693,799 A * 12/1928 Scofield ..... A41C 1/06 450/19
1,815,664 A * 7/1931 Bennett ..... A41C 3/00 450/85
1,829,100 A * 10/1931 Maier ..... A41D 7/00 450/61
1,961,048 A * 5/1934 Jacob ..... A41C 3/0021 450/59
2,052,707 A * 9/1936 Haimoff ..... A41C 3/00 450/61
2,115,397 A * 4/1938 Rosenthal ..... A41C 3/00 24/698.2
2,118,378 A * 5/1938 Graham ..... A41C 3/00 450/86
2,149,819 A * 3/1939 Rubinstein ..... A41C 3/00 450/63
2,156,478 A * 5/1939 Kemp ..... A41F 1/006 450/85
2,286,186 A * 6/1942 Kahn ..... A41C 1/06 450/19
2,400,499 A * 5/1946 Gerace ..... A41C 3/0021 450/86
2,455,036 A * 11/1948 Boylan ..... A41F 1/006 450/86

(Continued)

*Primary Examiner* — Jocelyn Bravo

(57) ABSTRACT

A brassiere designed to effectuate a stabilizing effect through the use of inner pockets along each bra cup held in place by the weight of breast overhang especially when the lower breast mass is below the breast crease line on the chest while simultaneously producing a stabilizing effect by way of rear pieces that distribute the breast weight from front to back to effectuate a cantilevering effect to diametrically opposing locations along a lower band adjacent to the lateral portions of the wearer's rib cage. Another component of the brassiere also distributes tension in the rear of the brassiere in a countervailing manner toward the band adjacent the spine of the wearer.

5 Claims, 5 Drawing Sheets

(56) References Cited

U.S. PATENT DOCUMENTS 2,497,938 A * 2/1950 Friedman ..... A41C 3/08 450/34
2,523,409 A * 9/1950 Wittenberg ..... A41C 1/00 450/19
2,600,645 A * 6/1952 Harrington ..... A41C 3/06 450/83
2,676,321 A * 4/1954 Dubner ..... A41C 3/06 450/83
2,794,986 A * 6/1957 Anderson ..... A41D 7/00 450/74
2,881,765 A * 4/1959 Sloate ..... A41C 3/00 450/71
3,071,140 A * 1/1963 Adler ..... A41F 15/00 450/86
3,110,313 A * 11/1963 Plehn ..... A41C 1/06 2/DIG. 9
3,120,848 A * 2/1964 Seperack ..... A41C 3/00 450/86
3,220,415 A * 11/1965 Marino ..... A41C 3/00 450/86
3,378,012 A * 4/1968 Schwartz ..... A41C 3/0007 450/60
3,411,510 A * 11/1968 Child ..... A41C 3/00 450/74
3,746,007 A * 7/1973 Hand ..... A41D 10/00 450/86
3,952,752 A * 4/1976 Huttle, Jr. ..... A41C 3/0021 450/60
4,191,192 A * 3/1980 McDavid ..... A41C 3/0057 450/33
4,292,975 A * 10/1981 Champion ..... A41C 3/0057 450/74
4,311,150 A * 1/1982 Schreiber ..... A41C 3/0057 450/86
4,325,378 A 4/1982 Wilkinson
4,449,533 A * 5/1984 DiTullio ..... A41C 3/00 D2/708
4,655,224 A * 4/1987 Stern ..... A41C 3/00 450/67
4,816,005 A * 3/1989 Braaten ..... A41C 3/02 450/74
D381,188 S * 7/1997 Allen ..... D2/706
5,823,851 A * 10/1998 Dicker ..... A41C 3/0057 450/74
6,023,785 A * 2/2000 Johnson ..... A41C 3/0057 450/63
6,059,633 A 5/2000 Currier
6,168,498 B1 * 1/2001 Wagner ..... A41C 3/0057 450/1
6,176,761 B1 * 1/2001 Underhill ..... A41C 3/0014 450/1
6,206,753 B1 * 3/2001 Werner ..... A41C 3/122 450/52
6,550,286 B2 * 4/2003 Querquant ..... D04B 1/246 450/40
6,935,921 B1 8/2005 Eudenbach et al.
7,396,272 B1 7/2008 Newlen
7,435,155 B2 * 10/2008 Reinisch ..... A41C 3/0057 450/59
7,588,479 B2 * 9/2009 Falla ..... A41C 3/0028 450/74
7,695,343 B2 * 4/2010 Nobbs ..... A41C 3/02 450/60
7,806,748 B2 * 10/2010 Richardson ..... A41C 3/02 450/86
7,909,675 B1 * 3/2011 Rainey ..... A41C 3/02 450/59
D678,659 S * 3/2013 Lopez ..... D2/708
8,647,168 B2 * 2/2014 Anvaripour ..... A41C 1/003 450/74
8,758,081 B2 6/2014 Yuasa et al.
8,758,082 B1 * 6/2014 Woods ..... A41C 3/04 450/86
8,769,726 B2 * 7/2014 Burke ..... A41D 1/089 2/403
8,784,347 B1 * 7/2014 Smith ..... A61F 5/03 602/61
8,887,315 B2 * 11/2014 Boynton ..... A63B 23/12 2/24
8,900,032 B2 12/2014 Punsal
8,932,103 B2 * 1/2015 Hansen ..... A41C 3/0028 450/86
9,161,574 B2 * 10/2015 Swendseid ..... A41C 3/0028
9,192,197 B2 * 11/2015 Reinhard ..... A41C 3/02
9,498,004 B2 * 11/2016 Farrell ..... A41C 3/0064
9,578,901 B2 * 2/2017 Randall ..... A41C 3/02
9,700,080 B1 * 7/2017 Hansraj ..... A41C 3/0021
10,117,469 B2 * 11/2018 Abbott ..... D04B 1/246
10,201,192 B1 * 2/2019 Lott ..... A41C 3/02
10,321,723 B2 * 6/2019 Kelley ..... A41C 3/0057
10,357,065 B2 * 7/2019 Donlon ..... A41C 3/0028
10,448,679 B1 * 10/2019 Roddis ..... A41C 3/0057
10,736,364 B2 * 8/2020 Liu ..... A61F 5/026
10,856,586 B2 * 12/2020 Hirakubo ..... A41C 3/0021
10,881,154 B2 * 1/2021 Cavosie ..... A41C 3/10
10,959,466 B2 * 3/2021 Kelley ..... A41C 3/0057
11,051,964 B1 * 7/2021 Lee ..... A41C 3/005
11,172,710 B2 * 11/2021 Storelli ..... A41C 3/0028
2006/0252346 A1 * 11/2006 Reinisch ..... A41C 3/0028 450/86
2009/0047868 A1 * 2/2009 Donnelly ..... A41C 3/0021 450/1
2010/0120329 A1 5/2010 MacDonald
2010/0130098 A1 5/2010 Kammerer
2011/0177757 A1 * 7/2011 Swendseid ..... A41C 3/0057 2/113
2011/0244758 A1 * 10/2011 Boatright ..... A41C 3/0035 450/92
2012/0064799 A1 * 3/2012 Rivers ..... A41C 3/0035 450/86
2012/0122370 A1 * 5/2012 Heath ..... A41C 3/0057 450/80
2012/0129430 A1 * 5/2012 Gleeson ..... A41C 3/0021 450/80
2012/0171930 A1 * 7/2012 Kaufman ..... A41C 3/0035 450/58
2012/0244782 A1 * 9/2012 Pundyk ..... A41C 3/0057 450/70
2013/0065486 A1 * 3/2013 Hansen ..... A41C 3/0064 450/59
2013/0122780 A1 * 5/2013 McCall ..... A41C 3/0014 450/36
2014/0235139 A1 * 8/2014 Chayet ..... A41C 1/003 450/95
2015/0004877 A1 * 1/2015 Bailey ..... A41F 15/02 450/86
2015/0223525 A1 * 8/2015 Miller ..... A41C 3/0085 450/65
2015/0296896 A1 10/2015 Laguna
2016/0073698 A1 3/2016 Blackmon-Humphrey
2016/0338421 A1 11/2016 Caprow-DAvanzo
2016/0360800 A1 * 12/2016 Yuasa ..... A41C 3/0028
2017/0360118 A1 * 12/2017 Randall ..... A41C 3/02
2018/0070653 A1 * 3/2018 Montford ..... A41C 3/0014
2018/0153226 A1 6/2018 Agee et al.
2019/0008214 A1 * 1/2019 Kaye ..... A41C 3/0028
2019/0082749 A1 * 3/2019 Ward ..... A41F 15/002
2019/0174840 A1 * 6/2019 Paulson ..... A41C 3/0014
2019/0297959 A1 * 10/2019 Liu ..... A61F 5/026
2020/0120994 A1 * 4/2020 Sanchez ..... A41C 3/124
2020/0323278 A1 * 10/2020 Roddis ..... A41C 3/005
2020/0383389 A1 * 12/2020 Cavosie ..... A41C 3/0028
2021/0186125 A1 * 6/2021 Lee ..... A41C 3/10
2021/0204618 A1 * 7/2021 Nogawa ..... A41C 3/144

* cited by examiner

BRASSIERE ADAPTED TO PREVENT UNDESIRED MOVEMENT WHEN WORN

BACKGROUND OF THE INVENTION

The present invention relates to brassieres and, more particularly, a wireless, front-closure brassiere adapted to prevent undesired movement of the breasts relative to each other and relative to the brassiere.

Brassieres (or bras) are difficult to fit properly as bodies are so different. Large breasts, especially when the lower breast mass is below the breast crease line on the chest, are especially difficult to keep in place without the use of tight straps and wires. Underwire, however, tends to poke the skin around the breast area and the straps tend to create uncomfortable dents in the shoulders. Furthermore, closures of hooks and eyes in the back of the bra make putting the bra on inconvenient and with the weight of the larger breast, the back-located hook and eye closures tend to bend and poke the wearer in the skin. Front closures that consist of a zipper, unfortunately, will not sit flat because the curve of the breast causes the zipper to buckle. Moreover, the back of the bra will creep up the wearer as the weight of the breast will pull the back up between the shoulder blades. Currently, bras that do not have wires do not keep the breasts in place and so the breasts do not stay in the cups. Traditional bras, excluding jog bras/sports bras, are often made of static fabrics or fabrics with minimal stretch and therefore do not move with the body.

Fabrics that are static or have minimal stretch are not adapted to move with the body, current bras do not keep the breasts in a stable position which forces the wearer to tighten straps over the shoulder or around the rib cage.

The current alternative to a wired or wireless bra is the jog bra/sports bra which is very constraining and squashes the breasts together forming a lump of breast mass that slips back and forth and often slips out from under the bra which also occurs with traditional bras.

Back closures are inconvenient and front zipper closures buckle because they do not take into account the curvature of the breast. Tightening straps to stabilize the breasts results in injured tissue. The use of an underwire intended to keep the breasts separated tends to poke the breast and surrounding tissue. The weight of the unstable breast pulls the back of wired and wireless bras up between the shoulder blades and can bend the hooks and eyes of the closures of the bra which then poke into the skin.

In short, the back of the bra is the most ignored but is a very essential part of a bra as it can help to hold the breasts in place—i.e., the weight of the breast is often not considered in the design of the back of today's bras, which is usually a simple strap with a hook eye closure or a plain or smooth material lacking architecture that helps distribute the weight of the breasts, which therefore causes the back to creep up between the shoulder blades. With tension in the correct places the back structure of the brassiere can distribute the weight of the breasts so as to overcome the above disadvantages.

As can be seen, there is a need for a wireless, front-closure brassiere adapted to prevent undesired movement of the breasts relative to each other and relative to the brassiere.

The design of this brassiere contains the breasts within the "pocket" cups without the use of wires and the weight of the breast itself is contained within the "pocket" cups, which are connected to the interior of the bra cups and rest against the wearer's chest wall especially when the lower breast mass is below the breast crease line on the chest. The two pieces that cross in the back of the brassiere have tension points that facilitate a cantilever effect. The manner of assembly of the back of the brassiere creates a downward and outward pull countervailed with a back piece that creates a downward and inward pull towards the wearer's spine that in conjunction with the stabilized breasts in the "pocket" cups prevents the back from creeping up between the shoulder blades and thereby keeps the straps from being tightened, preventing injury to the shoulders and prevents the need to tighten the band around the rib cage. The breasts will stay in place and will not slip out from under the cups as the fabric that is along the interior of each cup and sits against the chest wall underneath the breast also prevents the breasts from flowing out of the top of the cups or slipping out below. The breasts will not need to be squashed tightly into a 'uniboob' to be kept in place. This brassiere will separate the breasts in the "pocket" cups and keep them in a stable position as a keyhole zipper design in the front of the bra will keep the bridge of the bra close to the chest wall. As a result, the zipper above the keyhole and hook and eye closure of the chest band in the front of the bra does not buckle and makes it easy to put on and remove. The gathering in the back will keep the back of the brassiere in place without creeping upward between the shoulder blades. The entire brassiere may be made of four-way stretch fabric so as to move with the body in all directions. In addition to the fabric stretching, elastic has been added in strategic places for the bra to fit on the body in areas that can be of varying sizes depending on the shape of the person wearing the bra, keeping the bra snug without being tightened in an effort to compensate for a bad fit.

In sum, the present invention embodies a design that does not require the tightening of straps nor the use of a confining jog bra/sports bra to stabilize the wearer's breasts. The back design of the present invention prevents the back from creeping up between the shoulder blades or bending the hooks that then poke into the back-skin tissue. The front closure is convenient to put on and take off and does not buckle. The gathering in the back keeps the back in place and distributes the weight of the breasts down and across the back of the bra. The stretch fabric and elastic elements are designed to move with the body.

SUMMARY OF THE INVENTION

In one aspect of the present invention, an upper garment includes the following: two bra cups having a centrally disposed cup acme portion; a pocket along an inner surface of each bra cup, wherein opposing upper ends of each pocket are attached to opposing sides of each bra cup and contain the overhang or lower breast mass that is below the breast crease line on the chest therein; a rear component having the following: two rear acme portions, wherein each rear acme portion aligns with a respective cup acme portion; and two upper tapering stitchings extending downwardly in opposing directions from a first convergence of the two rear acme portions, wherein the two upper tapering stitchings terminate at two diametrical locations, respectively along a band dimensioned and adapted to wrap around a rib cage of a wearer.

In another aspect of the present invention, the upper garment further includes the following: a lower stitching extending upwardly from each diametrical location to a second convergence downward of the first convergence; a second piece interconnecting each lower stitching to the band in such a way that tensile forces along each lower stitching is directed to a location on the band adjacent to a spine; a zipper bridge detachably connecting intermammary edges of the two bra cups; a keyhole gap between the zipper bridge and a band closure of the band; an elastic band stitched into an upper stitching along an upper edge of the rear component and an upper stitching along an upper edge of each bra cup, wherein each stitching is zigzag stitching (a.k.a. accordion stitching), wherein the two bra cups, the band, and the rear component are made of four-way stretch material; and a strap interconnecting each rear acme portion and respective cup acme portion.

In yet another aspect of the present invention, an upper garment includes the following: two bra cups, each dimensioned and adapted to accommodate a breast of a human wearer; a band dimensioned and adapted to wrap around a rib cage of the human wearer; a pocket along an inner surface of each bra cup, wherein opposing upper ends of each pocket are attached to opposing sides of each bra cup in such a way that stabilizes the movement of the breast that is contained within the pocket whereupon the weight of the breast holds said pocket against the chest wall; and a rear component having two upper tapering stitchings extending downwardly from a load bearing point in opposing directions to diametrical locations of the band adjacent to a lateral-most portion of said rib cage, respectively to facilitate a cantilevering effect.

These and other features, aspects and advantages of the present invention will become better understood with reference to the following drawings, descriptions and claims.

DETAILED DESCRIPTION OF THE INVENTION

Figure 1:
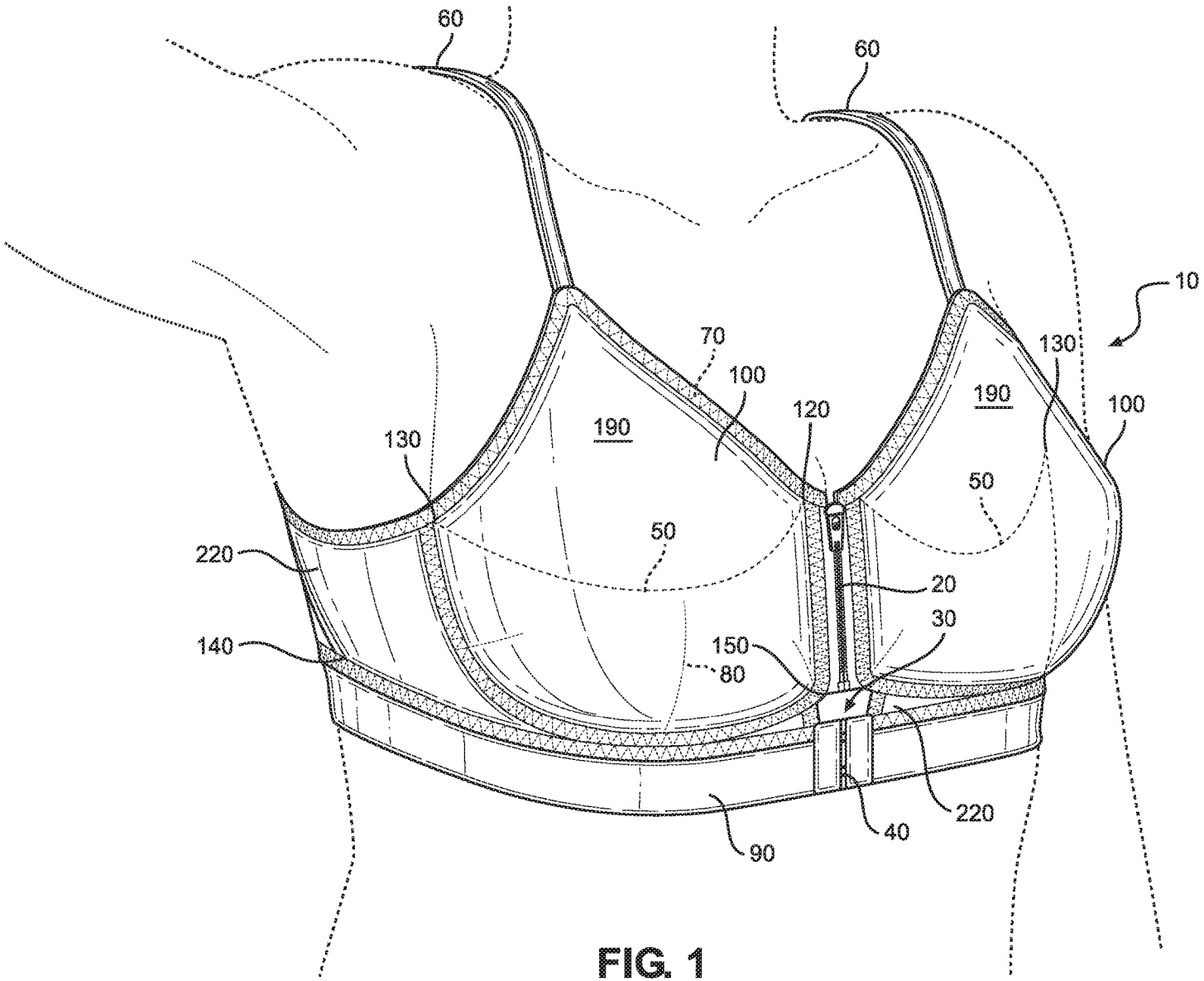
FIG. 1 is a front perspective view of an exemplary embodiment of the present invention shown in use and the inner pocket shown in dashed lines.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring now to FIGS. 1 through 5B, the present invention may include a brassiere 10 designed to stabilize the position of breasts 190 through the use of inner pockets 50 along an interior of each bra cup 100 and rear pieces 220, 210 that distribute the weight of the breast effectuating a cantilever effect to prevent the rear of the brasserie from rising up between the shoulder blades of the wearer.

It is understood that the brassiere 10 could be any form-fitting undergarment designed to support or cover the wearer's breasts. The brassiere 10 may be composed of four pieces 100, 50, 210 and 220 and a band 90. Each of the four pieces 100, 50, 210 and 220 and the band may be made of four-way stretch material. The four-way stretch material may have stretch horizontally and vertically with excellent recovery. The band 90 may be dimensioned and adapted to wrap around the lower chest, defining a lower boundary of the brassiere 10.

Figure 4:
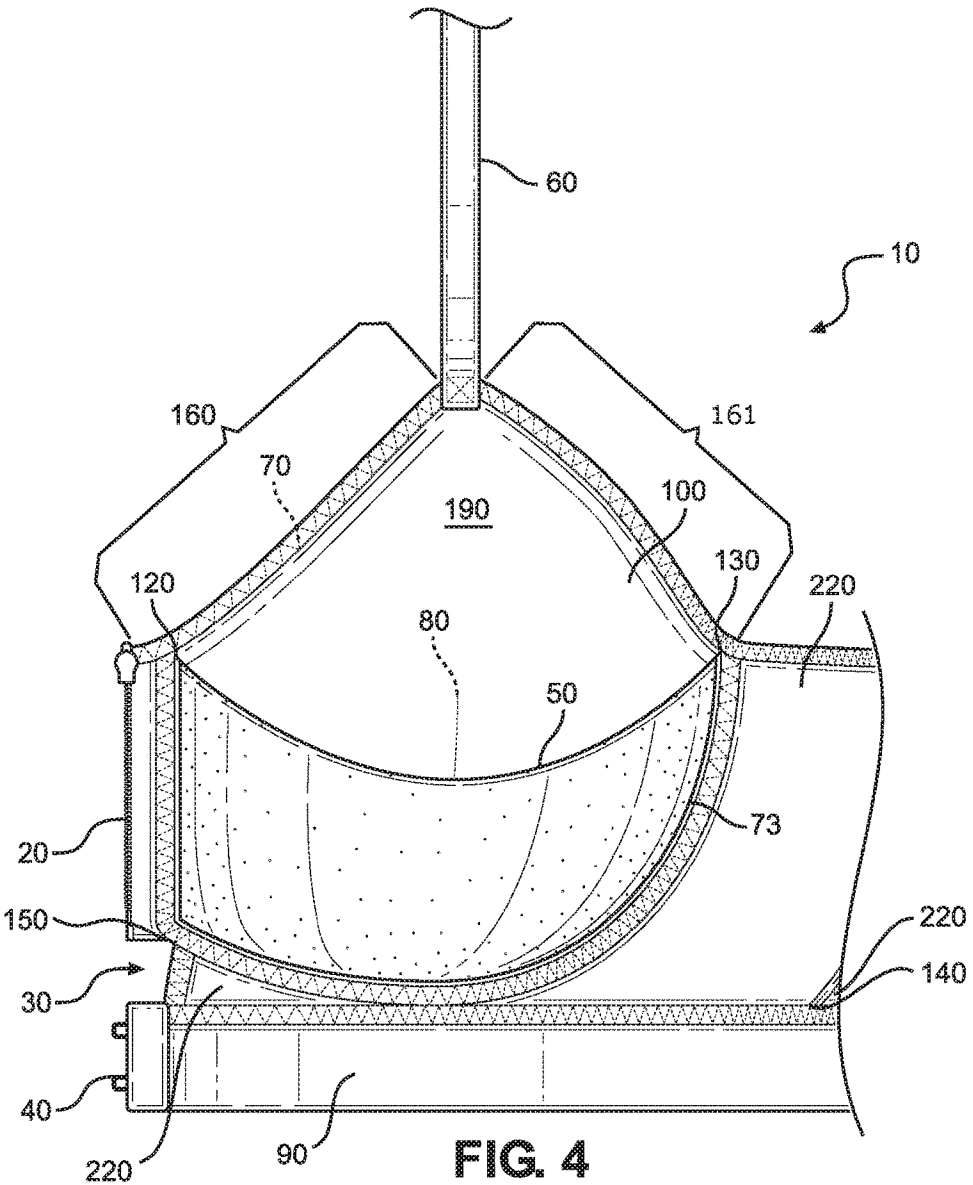
FIG. 4 is a detailed elevation view of an interior of one bra cup and inner pocket of an exemplary embodiment of the present invention.

Referring to FIG. 4, each piece 100 forms the main body of each bra cup. Each piece 100 may provide for darts 80 where suitable for a bra cup. A lower portion of piece 100 connects to a curved proximal portion 73 of piece 220 by way of a joining method, such as zigzag stitching (a.k.a. accordion stitching). At the proximal-most portion 220 of the curved distal portion 73 is first attachment point 150.

Opposite said lower portion, the piece 100 provide a 'peak' shape defined by a first upper edge 161 (which faces the armpits of the wearer) and an opposing second upper edge 160. At the acme of the peak shape is where a brassiere strap 60 attaches.

Figure 3:
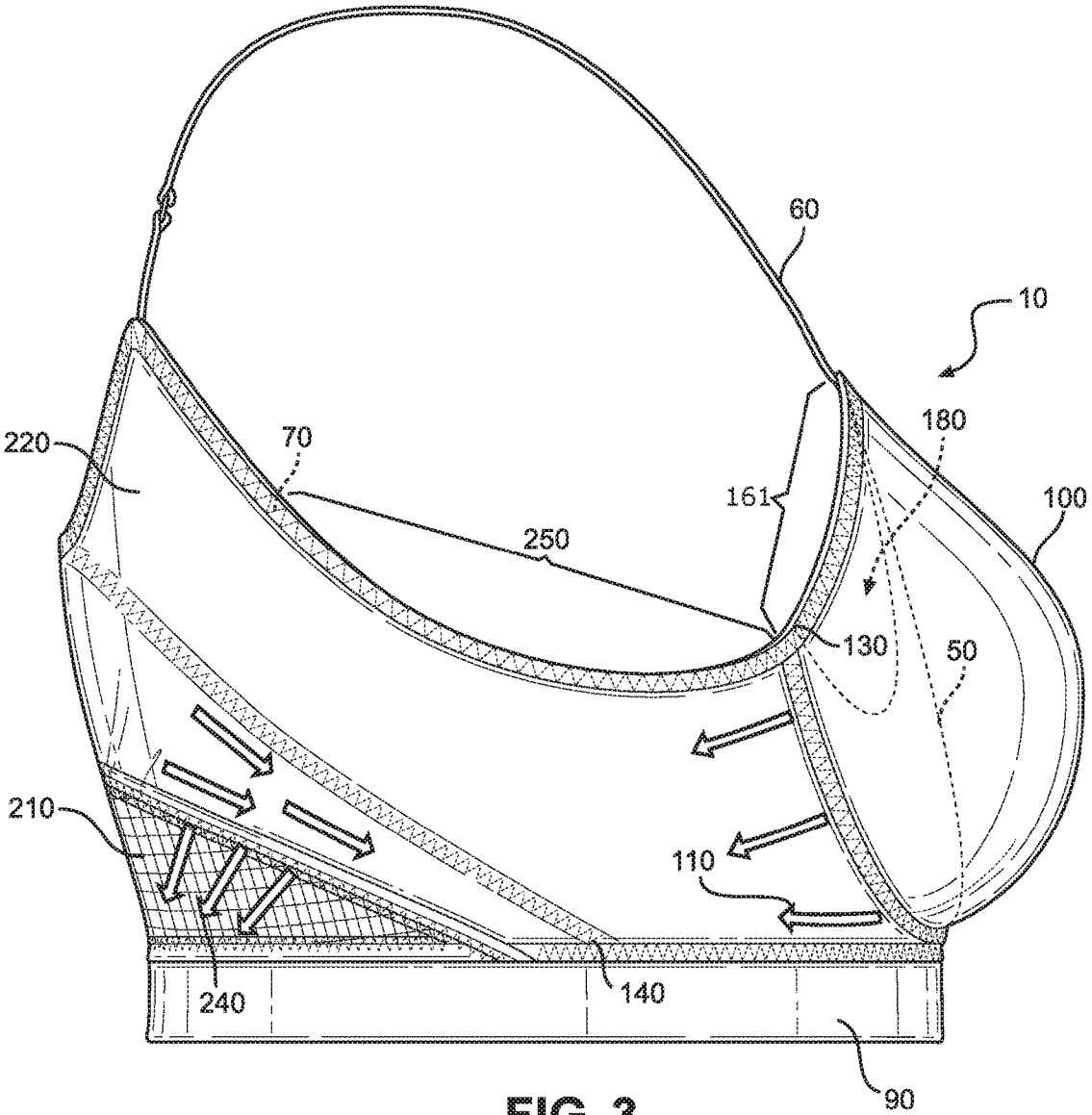
FIG. 3 is a side elevation view of an exemplary embodiment of the present invention, the inner pocket shown in dashed lines, wherein the arrows show the direction of tension and support.

The first and second upper edges 161 and 160 may have zigzag stitching with a bounded edge 70 that provide elastic tension. The zigzag stitching with a bounded edge 70 may be wrapped with spandex or similar fabric and may include attaching a thin elastic band that gathers the first and second upper edges 160 and 161 thereby creating tension along said edges and a snug fit for each breast. This zigzag stitching with a bounded edge 70 of spandex or similar fabric may also be used along the span 250, as illustrated in FIG. 3, keeping the brassiere 10 form-fitting and snug regardless of the wearer's body type whereby when attaching the fabric strip of spandex or similar fabric to bind the edge 70 the manufacturer may add extra tension along the span 250.

Piece 50 is connected adjacent an interior lower edge 73 of piece 100 by way of a joining method, such as zigzag stitching, and the opposing corners of piece 50 are attached to the cup 100 at point 120 along the lower edge 73 to point 130 thereby forming said inner pocket 50, wherein the weight of the breast 190 of a wearer is supported by the inner pocket 50. Tension directed rearward 110 is developed by the pull of the rear piece 210 in conjunction with point 140, as illustrated in FIG. 3. The span of tension 250 in conjunction with the countervailing point 140 and the tension from piece 210 prevents the fabric from buckling in the area of the bra under the armpit.

Figure 2:
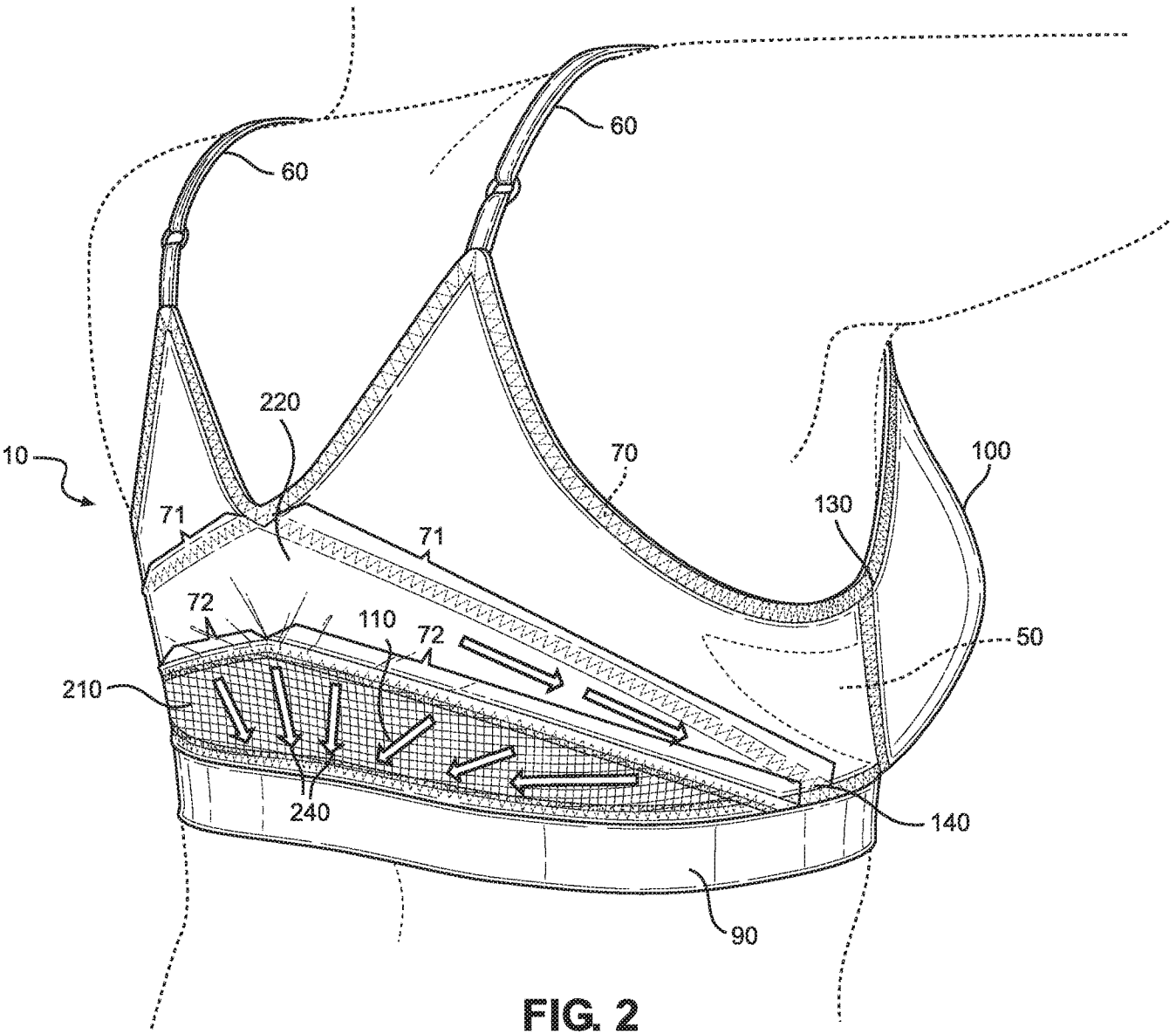
FIG. 2 is a rear perspective view of an exemplary embodiment of the present invention shown in use with the inner pocket shown in dashed lines, wherein the arrows show the direction of tension and support.

Referring to FIG. 2, rear pieces 220 crisscross to define a rear surface of the brassiere 10. Each rear piece 220 has an upper tapering edge 71 and a lower tapering edge 72 that converge at a third tension point 140 at the distal end of each rear piece 220. When the overlapping rear pieces 220 are attached to each other (in a crisscross condition) each distal end is disposed adjacent to the proximal end of the other rear piece 220. The proximal end of each rear piece 220 attaches to a portion of the piece 100. The upper tapering edge 71 of each piece 220 is zigzag stitched (a.k.a. accordion stitched) where it overlaps the other piece 220 where upon the zigzag stitching allows the pieces 220 to elongate.

An upper most point of each piece 220 connects to a strap 60 that extends (over the shoulder of a wearer) to the acme of a respective piece 100.

Piece 210 interconnects the bottom edge 72 of the rear pieces 220 to the band 90. When attaching piece 210 to the bottom edge 72, a manufacturer may start at center back and gently pull piece 210 so that when the sewing is complete, piece 220 is gathered along the bottom edge 72 whereupon piece 210 is taut in relationship to the pieces 220 effectuating a downward pull from the sides of the bra to center of the wearer's back.

Figure 5B:
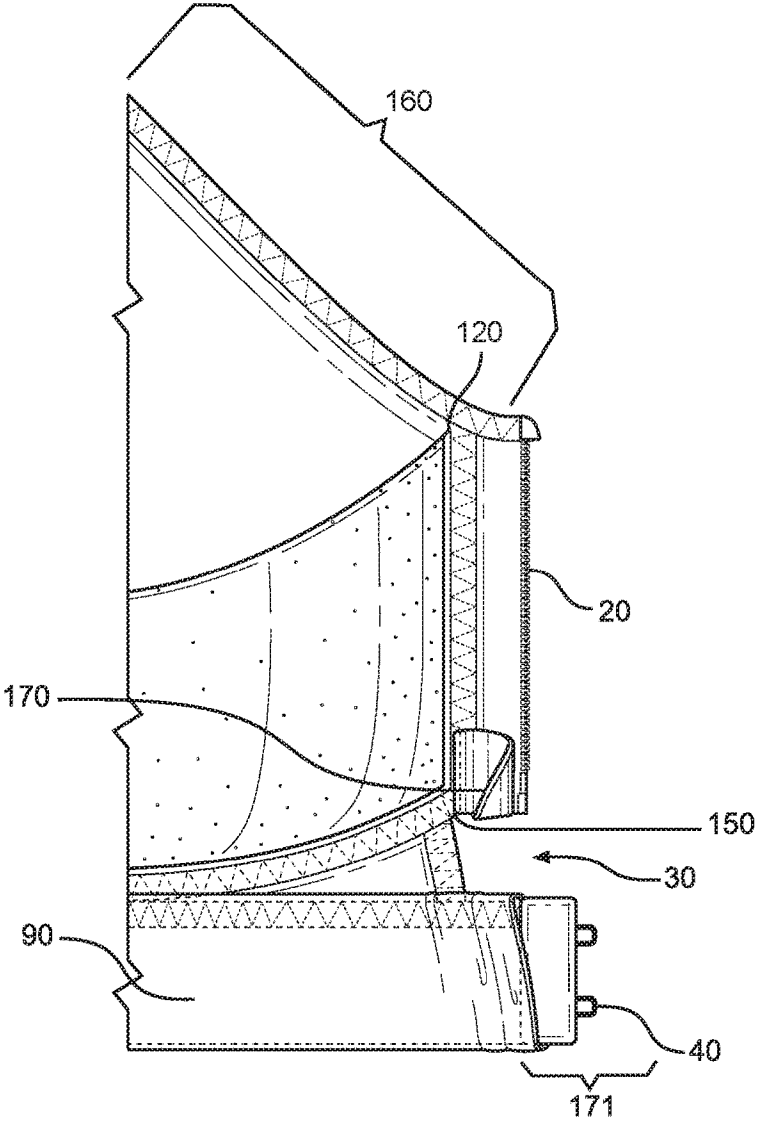
FIG. 5B is a detailed elevation view of an interior of a portion of a bra cup and inner pocket of an exemplary embodiment of the present invention.
Figure 5A:
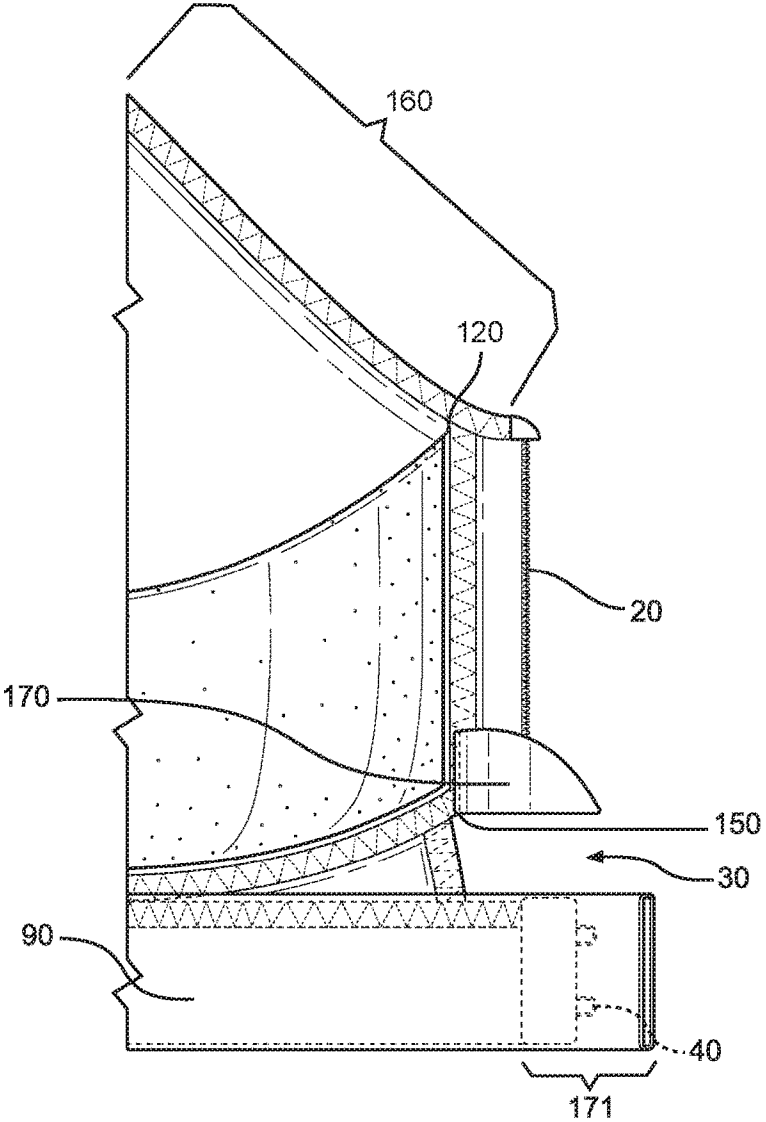
FIG. 5A is a detailed elevation view of an interior of a portion of a bra cup and inner pocket of an exemplary embodiment of the present invention.

A separating zipper bridge 20 may interconnect the intermammary edges of the pieces 100. Specifically, the zipper bridge 20 may be connected to a distal end of the second upper edge 160, of each piece 100, as illustrated in FIG. 4. Beneath the zipper bridge 20 is a keyhole gap 30 that communicates to the band connectors 40 on opposing ends of the band 90. The band connectors 40 may be hook and eye closures. There may be an extendable portion 171 of the band 90 to cover the band connectors 40, as illustrated in FIGS. 5A and 5B. The bottom of the zipper bridge 20 may provide a zipper cover 170. Both items 170 and 171 would protect the wearer from irritation of the skin from either a zipper or a hook and eye closure.

Rear pieces 220 enables a stabilizing and cantilevering effect as the tension in each strap 60 is transferred through the zigzag stitching of the upper tapering edge 71 and the lower tapering edge 72, this tensile force converges at the attachment point 140 of the distal end. It being understood that the convergence of force oriented in opposing direction may result in the cancellation and/or balancing of forces, thereby furthering the stability and lessening of displacement. The two attachment points 140 are attached to the band 90 at very spaced apart, approximately diametrically opposing, locations thereof.

Generally, when worn, the brassiere 10 provides the two attachment points 140 adjacent at two locations along the rib cage of the wearer that are the furthest possible distance apart. In medical terms, the two locations of the attachment points 140 are approximately the furthest away from the sagittal plane along the coronal plane. By distributing the weight of the breast towards the back through the two attachment points 140, the weight of the breast is prevented from pulling the rear of brassiere 10 upward between the shoulder blades; rather, the band 90 can resist the upward pull because of the manner of assembly of the back pieces 210 and 220. Likewise, this stabilizing effect in conjunction with the tension of span 250 along upper edge 70 keeps the area under the arm from becoming baggy.

Furthermore, the piece 210 transmits the tensile force in the lower tapering edge 72 toward the band 90 in a countervailing distribution 240, as illustrated in FIG. 2. Piece 210 is arched in such a way as to create tension that pulls the back downward, where the left side directs force toward the spine-located portion of the band 90, and the right side of piece 210 does the same, thus the countervailing distribution 240. The gathering connection 72 of the upper crossed pieces also urges additional downward tension that distributes the weight of the breasts to spaced apart locations along the band 90 (the two lateral/side locations and the spinal location). Piece 210 is stretched as it is attached with zigzag stitching to the edge 72 thereby creating a gathered edge of the upper crossed pieces 220 so that the piece 210 is taut in relationship to pieces 220 so that when upon wearing creates a downward and centralizing pull that keeps the back of the bra from riding upward between the shoulder blades. Thereby, the weight of the breasts is distributed throughout the back of the brassiere 10, as illustrated in the Figures. Without this crossed design, the wearer must rely on tightening shoulder straps so that the rear of the brassiere 10 does not creep up between the shoulder blades. Thus, tightening of the shoulder straps and the band encircling the chest is not required to keep the breasts from shifting or to keep the brassiere 10 from being baggy in the wrong places.

As mentioned above, piece 50 is attached to the bottom inner edge of the cup pieces 100 thereby creating "pockets" that hold the breasts in place. Furthermore the weight of the breast 190 works in conjunction with the piece 50 that sits between the back of the breast and the chest wall and holds the cup 100 in place. This keeps the brassiere 10 from shifting and keeps the breast 190 from spilling out from below the brassiere 10. As the weight of the breast 190 is taken into consideration and is used to anchor the brassiere 10, extra straps and excessive tightening or pressure from the fabric of the bra is not necessary.

Attaching the separating zipper bridge 20 creates the bridge of the brassiere 10 and ends at the inner lower curve of the breast and is not attached to the bottom band. This creates a keyhole gap 30 between the lower part of the zipper 150 and the band 90 thus preventing a buckling of the zipper because it takes into consideration the curve of the breast whereupon the darts in the bra cups 100 create convex cups. Points 120 and 150 along the edge 73 are anchored by piece 50 whereby the weight of the breast 190 holds said piece 50 against the chest wall and thereby holds the zipper bridge 20 close to the chest wall. The point 130 also facilitates the immobilization of the bra cup 100 where the weight of the breast is pressing against piece 50 or inner cup pocket. The hook and eye closure 40 in the front in conjunction with the zipper make it easy to put on and take off.

The four-way stretch material molds around the body and the breast itself. The thin elastic on the armpit side and top edge of the cup keeps the bra centered and snug. The spandex or similar fabric trim is gathered in strategic places which also keeps the bra snug and prevents the wearer from having to tighten shoulder straps or the band around the chest.

The four-way stretch fabric may be mid weight with excellent recovery. All pieces may be made from this type of material, with no shrinkage upon washing. All the stitching unless otherwise noted is zigzag (a.k.a. accordion stitching) so that the garment moves with the body. The gathering along the lower piece in the back and its arched shape gives necessary tension and tautness to piece 210 to keep the back from riding up between the shoulder blades and the gathering of the spandex or similar fabric strips along the edges of the cups and the area under the arms of the upper edge of the bra keeps the bra snug against the body thus preventing the need to tighten straps and the band around the chest. The extra thin elastic piece along the armpit edge of the cup 161 and top edge of the cup 160 keeps the cup snug against the body. The keyhole under the zipper and above the hook and eye closure keeps the zipper from buckling as it takes into account the curve of the breast. The back with its crisscross design creates a cantilever effect distributing the weight of the breast throughout the garment thus eliminating the need to tighten straps which cause discomfort. Uneven distribution of the weight of the breasts creates uneven pressure from the bra on the skin of the wearer especially if the fabric is static or has little stretch. This can cause discomfort and sometimes injury to the skin.

The "pocket" cups created by the additional piece of fabric 50 on the inside of the cup that sits between the breast and the chest wall acts as an anchoring element when the weight of the breast sits upon this fabric. This holds the bra in place and keeps the breast in place and thereby eliminates the need to tighten straps to keep bra from moving. It also keeps the breasts separated avoiding the "uniboob" without the use of wires that can irritate and injure skin which is so often the case. The use of a zipper and a hook and eye closure in the front makes putting on and taking off easy. The weight of the breasts is not bearing down on the hook and eye closure in the back where it is traditionally located as it has been distributed throughout the garment as described above and prevents the hooks from bending and therefore poking and injuring the skin. All the elements in this bra work together, one element cannot work without the other.

A method of making the present invention may include the following. All pieces including the band may be cut from four-way stretch material, horizontally, vertically or on a fold thereof. The method may include the following steps:

Step 1: Cross pieces 220 so that the non-cup edge meets tab on bottom edge of opposite piece.

Step 2: Zig Zag Stitch along upper edge of the pieces from tab end to middle back. Zig Zag Stitch piece 210 on arched edge to bottom of crisscrossed pieces 220. Center and stretch piece 210 to create a gathering of the bottom edge of crisscrossed pieces 220. Trim excess on either end of piece 210.

Step 3: Close the darts 80 of the cups 100 with a stitch.

Step 4: Attach pieces 50 to back side of each cup 100.

Step 5: Attach cup pieces 100 to the body of the brassiere 10 by sewing with a Zig Zag stitch, setting the cups 100 into the curved top edge of pieces 220 of the cup end of the garment.

Step 6A: Attach separating zipper to the bridge edge of the cup. Bottom end of zipper may start on small dart at point 150 of the bridge side of cup.

Step 6B: Wrap the upper edges of the bra with spandex 1" strips or similar fabric. Add tension while attaching strip from the armpit side of cup to back of bra just beyond the back of the arm.

Step 7: Add thin elastic to armpit and upper edge of cups gathering said edges.

Step 8: Fold a piece of material creating bottom band.

Step 9: Attach bottom band to bottom of bra. Add Hook and Eye closure to create keyhole.

Step 10: Attach shoulder straps.

All stitching is a zigzag stitch, unless noted. Use an appropriate thread, standard weight. The elastic used may be thin elastic. The trim that wraps around the unfinished edges of the garment may be 1-inch spandex or similar fabric and excess is trimmed. Shoulder straps are standard bra elastic straps 60 and can be of varying widths for this garment. Each brassiere 10 may require a ½-yard of 60" four-way stretch fabric. The zipper that creates the bridge of the bra may be a 4" separating zipper, trimmed to fit with the hook and eye closure 40 of desired width depending on desired width of under band.

The brassiere 10 embodied in the present invention is intended to be used as daily wear and is intended to replace wired bras that can cause discomfort from the poking of exposed wire and ill-fitting cups that are with or without underwire. It is also intended as a bra that does not use constriction to keep the breasts in place as with a jog bra/sports bra. The four-way stretch fabric and the pocket cups along with the tension and tautness created by the arched back piece and strategic gathering and the crisscross cantilevering of the back creates a bra with a non-binding snug fit and does not need tightening of the shoulder straps or under band. The breast sits in a natural position without slipping back and forth or slipping under the lower edge of the bra. The pocket design and the stretch fabric create comfort and a natural placement of the breast. This garment is intended for the breast that has some overhang especially when the lower breast mass is below the breast crease line on the chest as this overhang anchors the brassiere 10 in place holding down the fabric between the breast and the chest wall in the "pockets". The separating zipper and the hook and eye closure in the front create a keyhole and thereby eliminates the buckling of the zipper caused by the curve of the breast. This also makes it easy to put on and take off the bra.

It should be understood, of course, that the foregoing relates to exemplary embodiments of the invention and that modifications may be made without departing from the spirit and scope of the invention as set forth in the following claims.

What is claimed is:

1. An upper garment, comprising:

two bra cups each having a respective centrally disposed cup portion;

two pockets, each pocket positioned along an inner surface of a respective bra cup of the two bra cups, wherein opposing upper ends of each pocket are attached to opposing sides of each bra cup;

a rear component comprising:

two rear portions, wherein each rear portion aligns with a respective cup portion; and two upper stitchings extending downwardly in opposing directions from a first convergence of the two rear portions, wherein the two upper stitchings terminate at two diametrical locations, respectively along a band dimensioned and adapted to wrap around a rib cage of a wearer;

a zipper bridge detachably connecting intermammary edges of the two bra cups;

two lower stitchings extending respectively upwardly from each diametrical location to a second convergence downward of the first convergence;

an arched piece interconnecting each lower stitching to the band in such a way that tensile forces along each lower stitching are directed to a location on the band adjacent to a spine of the wearer; and a keyhole gap between the zipper bridge and a band closure of the band.

2. The upper garment of claim 1, further comprising:

an elastic band stitched into an upper stitching along an upper edge of the rear component and an upper stitching along an upper edge of each bra cup.

3. The upper garment of claim 2, wherein each stitching is zigzag stitching.

4. The upper garment of claim 3, wherein the two bra cups, the band, and the rear component are made of four-way stretch material.

5. The upper garment of claim 4, further comprising two straps, each strap interconnecting a respective rear portion to a respective centrally disposed cup portion.

* * * * *